US005242048A

United States Patent [19]

Ellingsworth et al.

[11] Patent Number: 5,242,048

[45] Date of Patent: Sep. 7, 1993

[54] JEWELRY AND ACCESSORY ORGANIZER

[75] Inventors: Karen K. Ellingsworth; Alvin J. Dolle, both of San Antonio, Tex.

[73] Assignee: Karen K. Ellingsworth, San Antonio, Tex.

[21] Appl. No.: 987,014

[22] Filed: Dec. 7, 1992

[51] Int. Cl.[5] ..... A47F 5/08

[52] U.S. Cl. ..... 206/6.1; 206/495; 211/13; 211/86; 211/87

[58] Field of Search ..... 206/6.1, 278, 279, 292, 206/294, 296, 493, 495, 566; 211/13, 87-89, 113

[56] References Cited

U.S. PATENT DOCUMENTS

| | | | |
|---|---|---|---|
| 3,339,745 | 9/1967 | Sugerman | 211/13 |
| 3,777,894 | 12/1973 | Swenson | 211/13 |
| 4,966,287 | 10/1990 | Snyder | 211/113 |
| 5,020,677 | 6/1991 | Wirth et al. | 211/113 |
| 5,067,617 | 11/1991 | Caldwell | 206/493 |

*Primary Examiner*—Jimmy G. Foster
*Attorney, Agent, or Firm*—Gunn, Lee & Miller

[57] ABSTRACT

A jewelry and fashion accessory organizer for retaining, displaying, and presenting for access a large number and variety of jewelry and fashion accessory items. The organizer comprises at least two side rails that are positioned parallel on a wall or a door surface so as to receive a number of cross rails each designed to retain, display, and present for access different types of jewelry and accessories. The cross rails include means for retaining earrings of both the pierced earring type and the clip on earring type, means for retaining jewelry and accessories that are looped in structure such as necklaces, bracelets, and belts, as well as a tray cross rail capable of holding any other loose items of jewelry not retainable by the other elements on the organizer. The organizer also includes side hook elements that may individually be placed and retrained by the side rails of the organizer. The structure of the organizer anticipates expansion of the basic assembly by the addition of side rails and the further incorporation of cross rails. The organizer can be customized by way of the selection of specific cross rails to the user's individual needs.

8 Claims, 7 Drawing Sheets

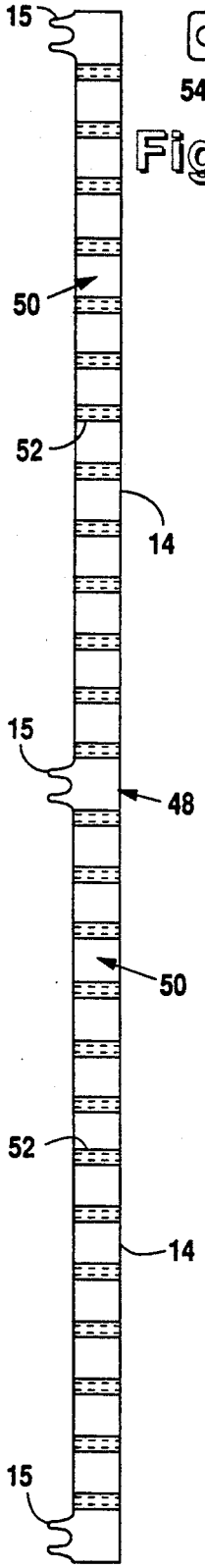
Fig. 3
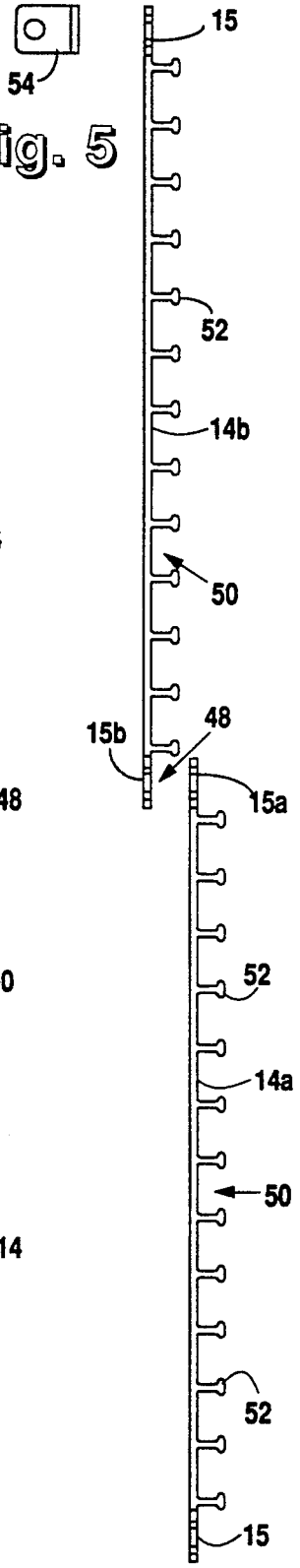
Fig. 4
Fig. 5
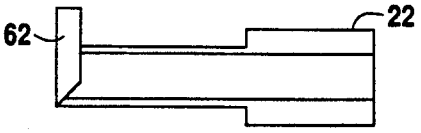
Fig. 6A
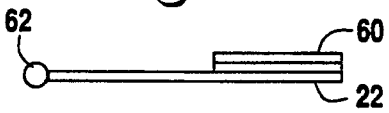
Fig. 6B
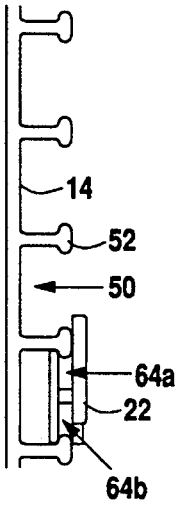
Fig. 6c
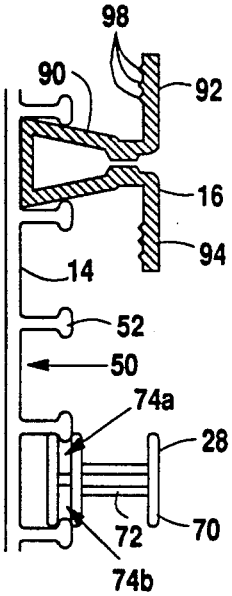
Fig. 7c
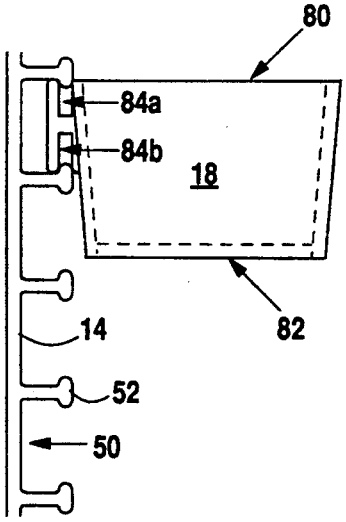
Fig. 8c

JEWELRY AND ACCESSORY ORGANIZER

BACKGROUND OF THE INVENTION

1. Field of The Invention

The present invention relates generally to the field of jewelry and fashion accessory holders and organizers. The present invention relates more specifically to an adjustable earring, necklace, bracelet, ring, and other accessory organizer and holder that is capable of being modified in its structure to retain and organize more or less of any particular type of jewelry or accessory.

2. Description of the Related Art

The common reference to a "jewelry box" typifies the state of the art in products to designed to hold, store, and organize jewelry and other fashion accessories. It has been found easiest in the past to create compartmentalized containers into which the various items of jewelry attire are stored. It is not unusual to find that jewelry holders for both men and women are designed to be placed on a dresser or counter top and are typically box-like structures with lids and internal individual compartments.

While many of the standard jewelry box designs organize the individual items quite well, they do little to make the items accessible to the user or to make the choice of which particular item to use, an easy one. The fact is that most jewelry containers or holders require the user to dig through the container for rings, or the container for earrings, or the container for necklaces, to find the one particular item that is desired. In many cases, it is not so important to find one particular item as to be given the opportunity to choose among a number of items to find the one that is most appropriate for the attire being worn.

It is known in the art to create jewelry holders, and especially earring holders, that display the items in a fashion more accessible to the user. There are a number of patents in the art specifically drawn to the storage and display of earrings of both the pierced type and the clasp type.

A number of these design to hold earrings incorporate a mesh fabric or screen through which the earrings are hooked or otherwise attached. Such designs include U.S. Pat. No. 5,050,745, issued to Saunders on Sep. 24, 1991; U.S. Pat. No. 4,767,011, issued to Butler on Aug. 30, 1988; U.S. Pat. No. 4,720,012, issued to DuFour on Jan. 19, 1988; and U.S. Pat. No. DES 315,654, issued to Hummel on Mar. 26, 1991, which all describe earring holders that incorporate mesh screens through which the earrings must be attached. While these jewelry or earring holder designs do display the individual items in such a way that the user can easily choose between them, they do not lend themselves to use with other types of jewelry or to use with earrings that do not provide an easy means for attaching or removing the items from the holder. In order that the individual earring items be held securely on the holder, they must be hooked into or attached through the material that makes up the mesh or fabric screen.

There are a number of designs that have been marketed and/or patented that attempt to overcome the limitations of these mesh or fabric screen designs. U.S. Pat. No. 4,739,886, issued to Seaberg on Apr. 26, 1988; U.S. Pat. No. DES 318,197, issued to Butler on Jul. 16, 1991; and U.S. Pat. No. 4,264,013, issued to Vollner on Apr. 28, 1981, all disclose alternative means for providing storage to either earrings or other items of jewelry.

The Seaberg and Vollner patents overcome some of the limitations of the mesh or fabric screen designs by incorporating hooks at a periphery of the earring holders for the purpose of retaining rings, bracelets, or necklaces. Seaberg also anticipates the use of a base tray in addition to a large planar upright surface for holding a plurality of earrings.

One of the most significant problems associated with any of the jewelry or fashion accessory holder design that is intended for placement on a horizontal surface, such as a dresser top or other counter top, is its general unavailability to the user when the user is picking out clothing items to be worn. As jewelry items are intended to be matched with certain types or colors of clothing items, it would be advantageous to have access both to the jewelry and fashion accessories and the items of attire that are being chosen at the time. It would be advantageous, therefore, to be able to use the jewelry and fashion accessory holder at the location where most clothing is kept prior to its selection, namely in a closet. A jewelry box or accessory holder that can only be placed on a dresser top or the like, makes it difficult to both select the items of clothing and to select the accessories to match those items at the same time.

While some effort has been made in the art to design jewelry and fashion accessory holders that can be attached to the wall or door of a closet, these designs have thus far been limited in their versatility. Generally, the designs are specifically intended for one particular type of fashion accessory such as pierced earrings and do not lend themselves to use with other types of jewelry items. The designs often end up being too complex and cumbersome to create an efficient presentation of the accessories for easy access, choice, and use. Thus far, the field has not produced a jewelry and accessory organizer that is both versatile, in that it is capable of holding, presenting, and allowing access to a variety of different items of jewelry and fashion accessories, and accessible in that it can be positioned on a closet wall or closet door so that the user might readily view the jewelry and fashion accessory holder at the same time as the items of clothing are being selected. It would be desirable, therefore, to have a jewelry and fashion accessory holder that is both versatile and accessible, and is simple in its configuration so that ease of use is established.

SUMMARY OF THE INVENTION

It is, therefore, an object of the present invention to provide a jewelry and fashion accessory organizer that is capable of holding, displaying, and allowing access to a variety of different items of jewelry and fashion accessories.

It is a further object of the present invention to provide a jewelry and fashion accessory organizer that is versatile in its ability to retain, display, and allow access to a variety of different items and is capable of being positioned adjacent to the clothing items, that the jewelry and fashion accessories are being chosen to go with.

It is a further object of the present invention to provide a jewelry and fashion accessory organizer that is versatile in its ability to hold a variety of jewelry and fashion accessories, accessible in its ability to be positioned near clothing items to be chosen, and variable in its configuration so that it might be custom configured for the specific needs of the individual user.

It is another object of the present invention to provide a jewelry and fashion accessory organizer that is versatile, accessible, capable of being customized, and is still simplistic in its design such that it is inexpensive, easy to manufacture, and durable in its use.

In fulfillment of these and other objectives, the present invention provides a jewelry and fashion accessory organizer that is composed of a number of interchangeable parts designed to be attached to and removed from a pair of rails that may be attached to the wall or door of the user's closet. The parallel rails of the present invention have means incorporated on them for the attachment of a variety of cross rails designed to secure, display, and allow access to a variety of different types of jewelry and fashion accessories. The present invention includes means for retaining pierced earrings, dangling clip earrings, button clip earrings, wire loop earrings, necklaces, bracelets, rings, scarves, pendants, belts, and a variety of other specific items of jewelry and fashion attire. The present invention is designed to be customized to the individual user's preferences and needs and is capable of indefinite extension with interlocking rails and cross rails. The present invention provides a unique means for the retention of pierced earrings that eliminates the need to remove the attachment means from the post of the pierced earrings prior to their retention by the holder.

BRIEF DESCRIPTION OF THE DRAWINGS

FIG. 3 is a detailed view of two sections of side rail comprising one half of the parallel side rails of the present invention.

FIG. 4 is a detailed side view of the two parallel rails shown in FIG. 3 showing their means for interlocking assembly.

FIG. 5 is a detailed front view of an attachment clip for terminating the end of the side rail shown in FIG. 4.

FIG. 6*a* is a detailed front view of a hook element of the present invention.

FIG. 6*b* is a detailed top view of the hook element shown in FIG. 6*a*.

FIG. 6*c* is a detailed side view of the hook element shown in FIG. 6*a* as it is attached to the side rails of the present invention.

FIG. 7*c* is a detailed side view of the attachment of the hanger cross rail to the side rail of the present invention, as well as a detailed view of the attachment of an earring cross rail to the side rail of the present invention.

FIG. 8*c* is a detailed side view of the attachment of the tray cross rail to the side rail of the present invention.

DETAILED DESCRIPTION OF THE PREFERRED EMBODIMENT

Figure 1:
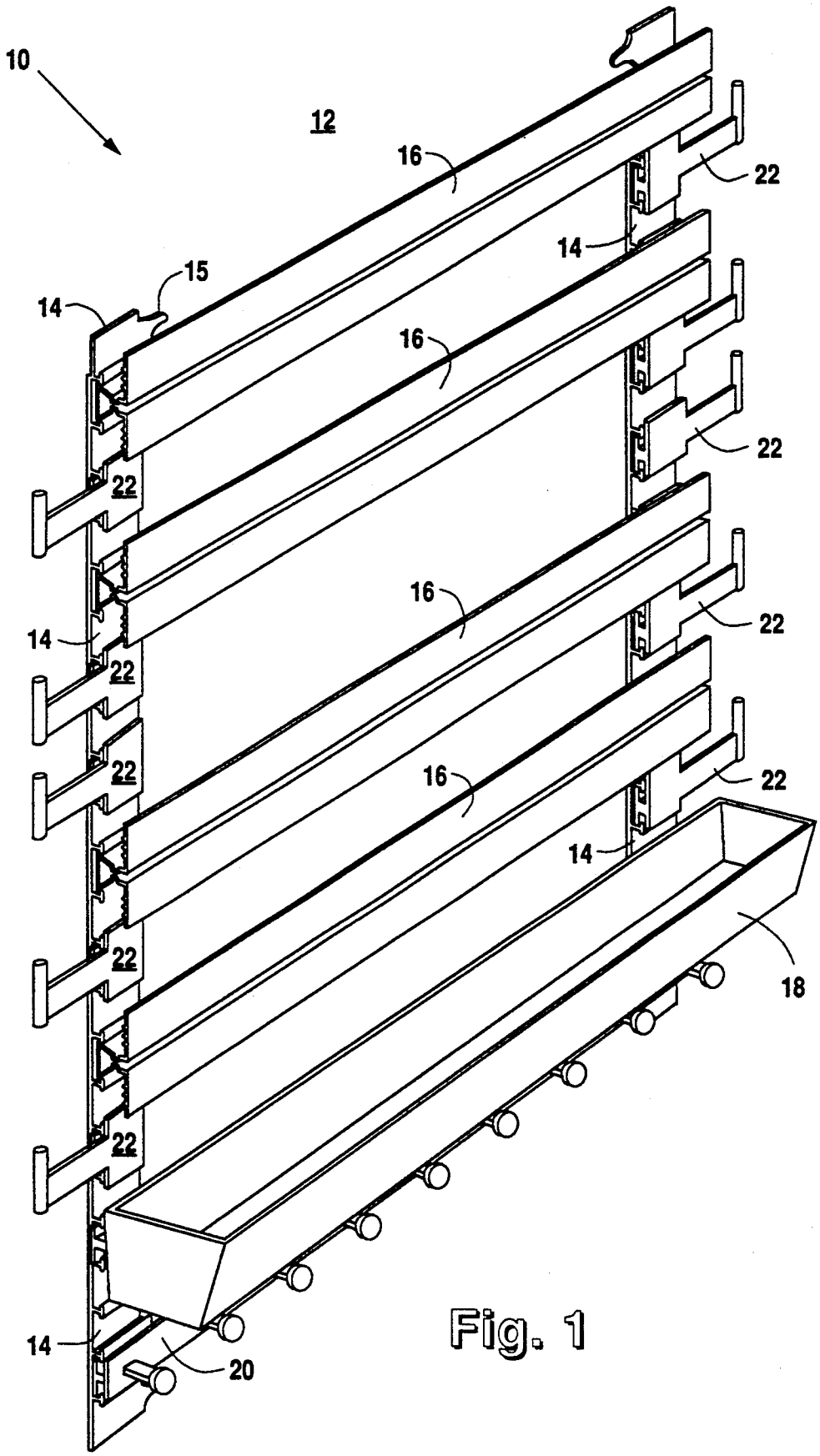
FIG. 1 is perspective view of a typical assembled jewelry and fashion accessory holder of the present invention.

Reference is first made to FIG. 1 for a perspective view of a typical assembly of the jewelry and fashion accessory holder of the present invention. The perspective view shows holder (10) as it might be assembled and positioned on the inside of door (12) of a closet for easy access by the user. The preferred embodiment anticipates that assembly (10) will be placed at approximately shoulder level for ease of display and ease of access to every portion of organizer (10).

The overall assembly (10) of the present invention as shown in FIG. 1 is comprised of four side rails (14) that are themselves attached to surface (12) of the closet door or wall in pairs of two, each pair parallel to the other. Attachment points (15) for side rails (14) are described in more detail below.

Extending between parallel side rails (14) are a plurality of cross rails (16, 18, and 20) of a variety of types. Included among cross rails (16, 18, and 20) in this typical configuration of the preferred embodiment, are a plurality of earring cross rails (16), a single tray cross rail (18), and a single loop hanger cross rail (20). In addition, there are a plurality of side hooks (22) attached to side rails (14) on each side of assembly (10).

The structure of side rails (14), as described in more detail below, is such that cross rails (16, 18, and 20) may be interchanged and repositioned at varying points either higher or lower on side rails (14). It can be seen that the entire assembly (10) of the preferred embodiment could include nothing but side rails (14) and earring cross rails (16), for example. More than one tray cross rail (18) could be implemented and, under certain conditions, more than one loop hanger cross rail (20) could be implemented on the assembly. In addition, as described in more detail below, additional side rails (14) may be extended below or adjacent to existing side rails (14) to further expand the overall organizer assembly (10). Also as will be described in more detail below, it can be seen that the spacing between parallel side rails (14) is not critical since the attachment of the cross rails to side rails (14) is by means of a continuous interlocking portion of cross rails (16, 18, and 20) that does not rely upon any particular positioning with respect to side rails (14).

Figure 2:
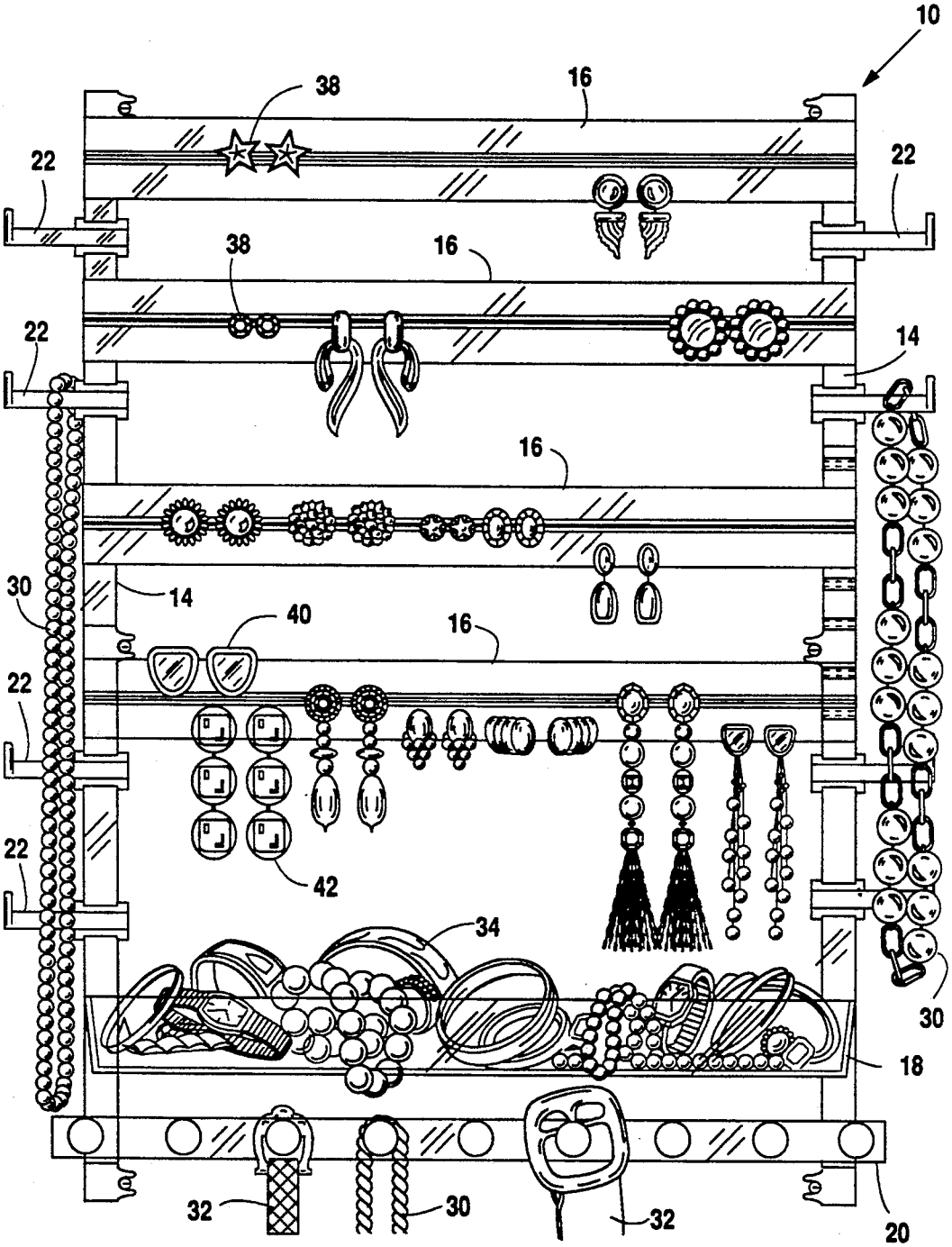
FIG. 2 is a front view of a typical jewelry and fashion accessory holder of the present invention.

Reference is now made to FIG. 2 for a detailed description of a front view of the assembly shown in FIG. 1 better portraying the appearance of organizer (10) with various items of jewelry and fashion accessories attached. Loop hanger cross rail (20) is shown with a number of necklaces (30), belts (32), and other loop type articles of jewelry and fashion accessories draped across or surrounding individual hangers (28) of cross rail (20). It is anticipated that loop hanger cross rail (20) would in most cases be attached at a lower end of assembly (10) such that the items which are draped across individual loop hangers (28) would not interfere with other items placed below them. In some cases, however, loop hanger cross rail (20) might be placed at an upper section of assembly (10) when it is anticipated that only bracelets, for example, might be displayed on cross rail (20).

Tray cross rail (18) typically is used for the retention of small items such as finger rings, pendants, etc. (not shown), that do not lend themselves easily to being attached in other ways on the overall assembly (10). It is anticipated that tray cross rail (18) might be subdivided into individual compartments (not shown) depending upon the requirements of the user. It is also anticipated that tray cross rail (18) might be constructed of a transparent material to further display the items therein.

Side hook attachments (22) are used in much the same way as loop hanger cross rail (20), albeit for shorter objects such as necklaces (30) that might not drape appropriately across loop hanger cross rail (20) hooks (28). Hereagain, the quantity of such side hooks (22) can be determined according to the needs of the user, but because they extend out from the side of assembly (10), no particular attention is required to the fact that the items placed on side hooks (22) drape in front of or interfere with other items on the assembly.

Figure 10A:
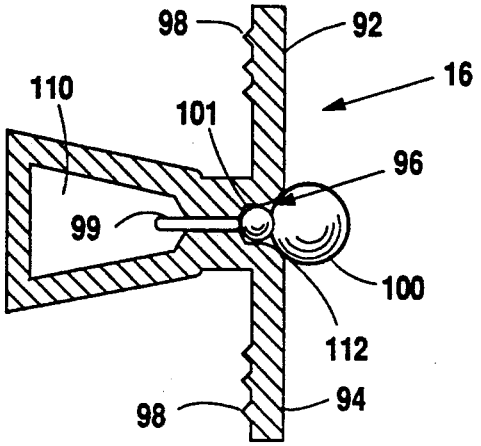
FIG. 10*a* is a detailed cross sectional view showing the means for attachment of a pierced earring to the earring cross rail of the present invention.
Figure 10B:
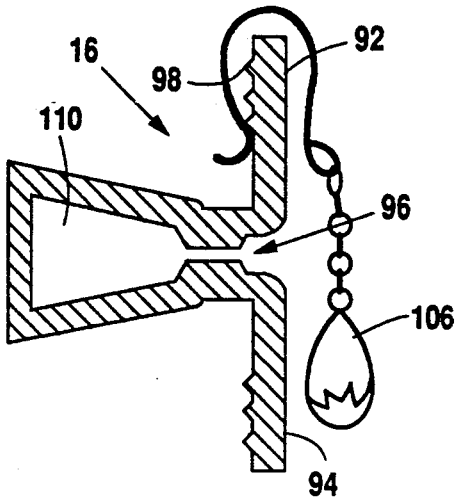
FIG. 10*b* is a detailed cross sectional view showing the means for attachment of a loop or hook earring to the earring cross rail of the present invention.
Figure 10C:
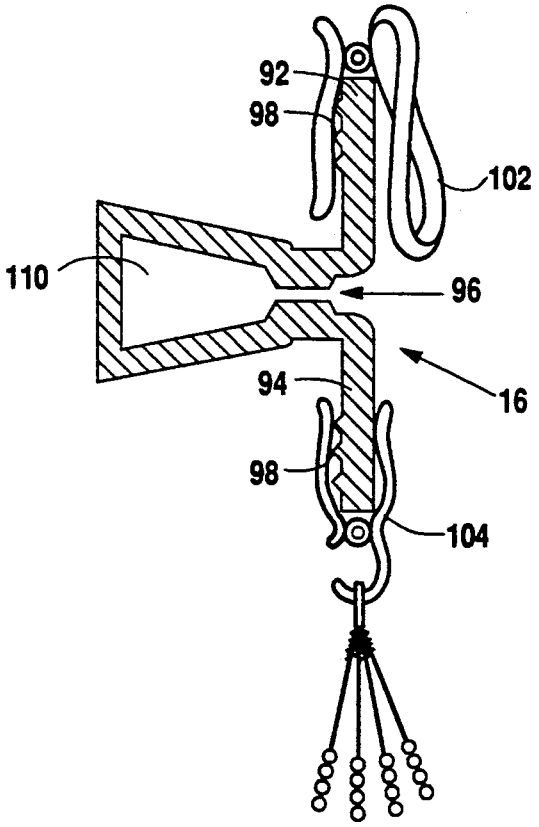
FIG. 10*c* is a detailed cross sectional view showing the means for attachment of a button clasp earring and a dangling clasp earring to the earring cross rail of the present invention.

As shown in FIG. 2, earring cross rails (16) are perhaps the most versatile component of organizer (10) in that they are capable of retaining and displaying, as described in more detail with respect to FIGS. 10*a–c*, earrings of a variety of types and configurations. Shown in FIG. 2 are pierced type earrings with studs (38) that are inserted into earring cross rail (16), as well as clip on type earrings (40 and 42) that may be attached to the upper edge of cross rail (16) or the lower edge of cross rail (16) depending upon the type of clasp earring.

Hereagain with respect to FIG. 2, it should be emphasized that one important feature of the organizer of the present invention is not only its versatility, but the ability of the user to customize the design of the organizer for their own personal needs. It is anticipated that the basic organizer assembly might have the arrangement shown in the preferred embodiment, although additional individual attachments and cross rails could be purchased to substitute or supplement those in the basic package. For example, if the user has a large number of bracelets (34), it might be preferable to replace one of earring cross rails (16) shown in FIG. 2 with an additional loop hanger cross rail (20) at a position perhaps near the top where bracelets (34) might easily be stored and displayed. Likewise, if the user has a larger number of rings or broaches (not shown) that would not be attachable to any other portion of the assembly, it might be preferable to add a second tray cross rail (18) at a middle position in the assembly. Assembly (10) shown in FIGS. 1 and 2, and as described in more detail in FIGS. 3 and 4, incorporates side rails (14) that have attachment points for at least 12 positions each for cross rails (16, 18, and 20) and/or side hooks (22). It is anticipated, however, and consideration is given in the present invention, for the extension of side rails (14) to allow expansion beyond basic assembly (10).

Reference is now made to FIG. 3 for a detailed description of side rails (14) that form the basic structure for organizer (10). The view in FIG. 3 is of two side rails (14) interlocked together for an extension of assembly (10) that doubles its overall size. Only one half of the set of parallel side rails (14) is shown as, for example, the right hand side of assembly (10) as viewed from the front. Left hand side rail of assembly (10) would simply be an inverted side rail (14) of that shown in FIG. 3.

The important elements of side rails (14) are cross rail attachment channels (50), shown better in FIG. 4 and described below, which number 12 per side rail in the preferred embodiment.

The second important feature of side rail (14) is its attachment point (15) to the wall or door surface of the user's closet. These attachment points (15) are simply slots configured to receive and be retained by typical threaded screws for attachment to a standard wooden door or wall surface. These attachment points (15) are open to facilitate the insertion and removal of side rails (14) from the surface of the door or wall.

Reference is now made to FIG. 4 for a further description of side rails (14) and the means for their interlocking attachment to the closet wall or door. The view in FIG. 4 shows channels (50) within which cross rails (16, 18, and 20) are interlocked so as to connect a left and right side rail (14) placed parallel on a door or wall surface. Channels (50) themselves are defined by a pair of T-shaped protrusions (52) from the base of rail (14) which mate with channels on each of cross rails (16, 18, and 20) in a manner described in more detail below. A single T-shaped protrusion (52), therefore, serves to potentially attach to a cross rail (16, 18, and 20) at both its top and bottom edge as seen in the side view of FIG. 4. In addition, it is seen in FIG. 4 that attachment points (15) of side rails (14) are staggered in depth so as to interlock with additional side rails (14) for expansion of the organizer. FIG. 4 discloses upper attachment point (15*a*) for first side rail (14*a*) and lower attachment point (15*b*) for second side rail (14*b*) that may be placed one on top of the other and retain a consistent flat base surface for attachment to the wall or door surface and still provide a secure interlocking assembly.

In FIG. 5 it is seen that as a result of the interlocking configuration of side rails (14) disclosed in FIG. 4, spacer attachment (54) is required to complete the upper end assembly. Attachment insert (54) is configured to be of dimensions appropriate for spacing the upper end of rail (14) from the wall or door surface as necessary.

Reference is now made to FIGS. 6*a* through 6*c* for a detailed description of the configuration and means for attachment of side hook elements (22) of the present invention. FIG. 6*a* is a front view of side hook element (22) configured and positioned as it might be attached to left hand side rail (14) of organizer (10). It will be noted that a right hand side hook (not shown) would be a mirror image of left hand side hook (22) shown in FIG. 6*a*, such that the attachment means (60) remains on the back side of side hook (22), despite the opposite orientation. Alternately, it is possible that the structure of side hook (22) shown in FIG. 6*a* as appropriate for left hand side rail (14) of organizer (10), might also be appropriate for right hand side rail (14) of organizer (10), albeit that hook portion (62) of the structure would be reversed and would be behind means for attachment (60) to side rail (14). Because of side rail (14) configuration, whether hook portion (62) is in front of or in back of attachment (60) is not important.

FIG. 6*b* shows a top view of side hook (22) showing the rounded structure of hook portion (62), as well as attachment channels (64*a* and 64*b*) described in more detail below.

FIG. 6*c* is a detailed side view of side rail (14) and side hook (22) showing the means for attachment. As described above, T-shaped protrusions (52) from side rail (14) work in pairs to engage opposing channels (64*a* and 64*b*) in attachment means (60) for side hook (22). First T-shaped protrusion (52) extends slightly into a top channel (64*a*) on side hook (22) and second lower T-shaped protrusion (52) extends into a lower opposite facing channel (64*b*) on side hook (22). The attachment shown in FIG. 6*c* would be typical for a side hook (22) attached to a left hand side rail (14) of organizer (10). Attachment for a right hand side rail (14) would be essentially the same, the only difference being the location of hook portion (62) of side hook (22) itself.

Figure 7A:
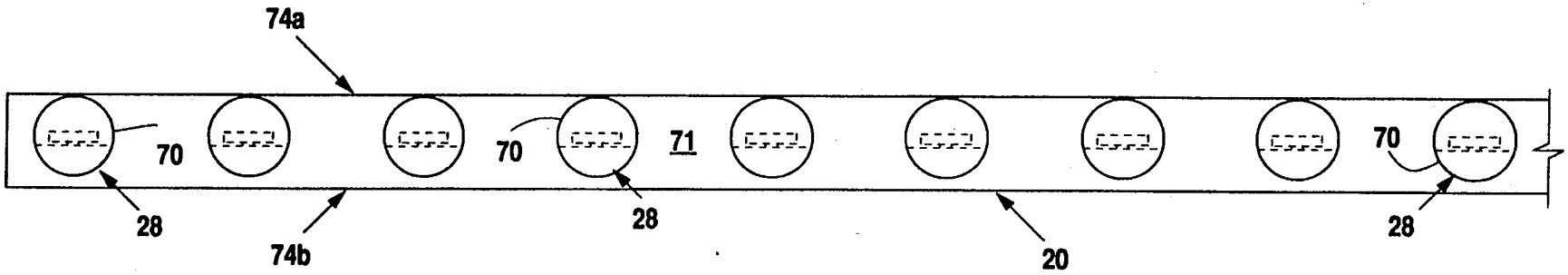
FIG. 7*a* is a detailed front view of a hanger cross rail of the present invention.
Figure 7B:
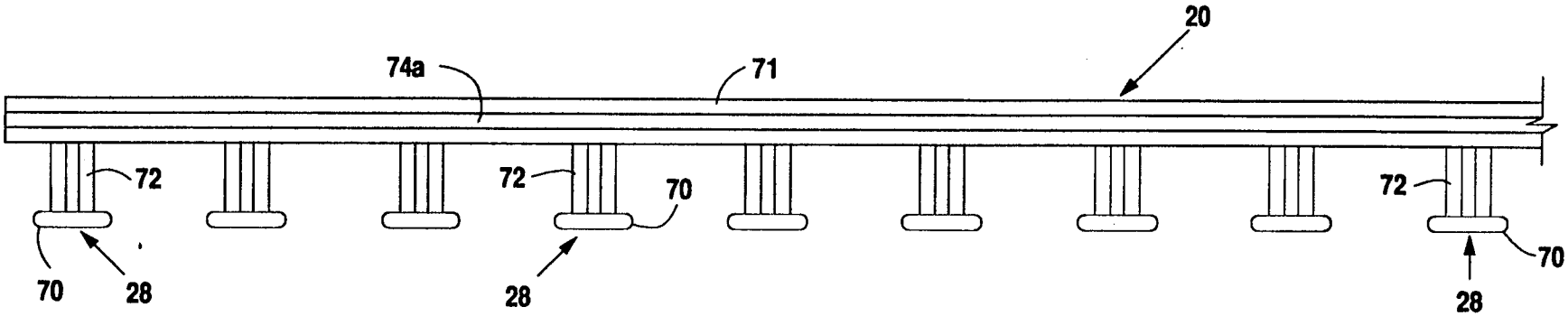
FIG. 7*b* is a detailed top view of the hanger cross rail shown in FIG. 7*a*.

Reference is now made to FIGS. 7*a* through 7*c* for a detailed description of loop hanger cross rail (20) of the present invention. FIG. 7*a* is a front view showing a plurality of loop hangers (28) as they would appear to the user. Loop hangers (28) are evenly spaced across loop hanger cross rail (20) and are comprised of disc shaped heads (70) that are attached to base section (71) of loop hanger cross rail (20), spaced from base (71) of loop hanger cross rail (20) a distance sufficient to allow the retention of typical articles of jewelry and fashion accessories. The spacing of loop hangers (28) is determined primarily by the types of items to be retained in a manner that will not crowd the items together and prevent their easy access. It is anticipated that more than one bracelet, necklace, or other loop shaped article of jewelry could be placed on any one loop hanger (28), though the arrangement is versatile enough to allow the user to organize and display the various loop items of jewelry in any manner appropriate.

FIG. 7*b* is a top view of loop hanger cross rail (20) showing in more detail the spacing of disc shaped heads (70) of individual loop hangers (28) from base (71) of loop hanger cross rail (20). FIG. 7*b* also shows the structural attachment of disc shaped head (70) to loop hanger cross rail (20) in a configuration that allows rigid attachment, yet sufficient space for a variety of jewelry and accessory types. Also shown in FIG. 7*b* is the position of the attachment channels (74*a* and 74*b*), similar to those described above with respect to side hooks (22), that extend along the entire length of loop hanger cross rail (20). The fact that these attachment channels (74*a* and 74*b*) extend along the entire length of these cross rails (20) allows for a variable spacing of side rails (14) that does not require they be positioned exactly at the terminal ends of cross rails (20).

In fact, it is anticipated that additional side rails (14) could be positioned parallel to an initial pair of parallel side rails (14) in such a fashion that a group of three parallel side rails (14) could be used for two sets of cross rail (20) attachments. In other words, attachment means (74*a* and 74*b*) do not require any symmetry beyond the fact that side rails (14) must be parallel. There is no requirement that cross rails (20) terminate or begin at the point of side rails (14), so a variety of non-symmetrical configurations could be implemented.

Reference is now made to FIG. 7*c* for a detailed description of the means of attachment of loop hanger cross rail (20) to side rails (14). In FIG. 7*c*, an end view of loop hanger cross rail (14) is shown as it would be attached to side rails (14). As with side hooks (22), attachment means (74*a* and 74*b*) on loop hanger cross rail (20) is comprised of two opposing channels (74*a* and 74*b*) that interlock with a pair of T-shaped protrusions (52) from side rails (14). Insertion of channels (74*a* and 74*b*) into side rails (14) involves connecting a first lower channel (74*b*) to a first top side of a T-shaped protrusion (52) and then rotating cross rail (20) so as to pivot upon this first attachment point to a point where upper opposing channel (74*a*) clips into contact with the lower edge of a second T-shaped protrusion (52). Alternatively, the attachment means permits sliding channels (74*a* and 74*b*) into contact with T-shaped protrusions (52) from the side. The flexibility of the material that organizer (10) is constructed from, however, makes preferable the clipping in and out of the various cross rails (16,18,20) to side rails (14) without the necessity of sliding attachment, even though possible. Reference will again be made to 7*c* below to describe the means of attachment of earring cross rails (16) to side rails (14).

Figure 8A:
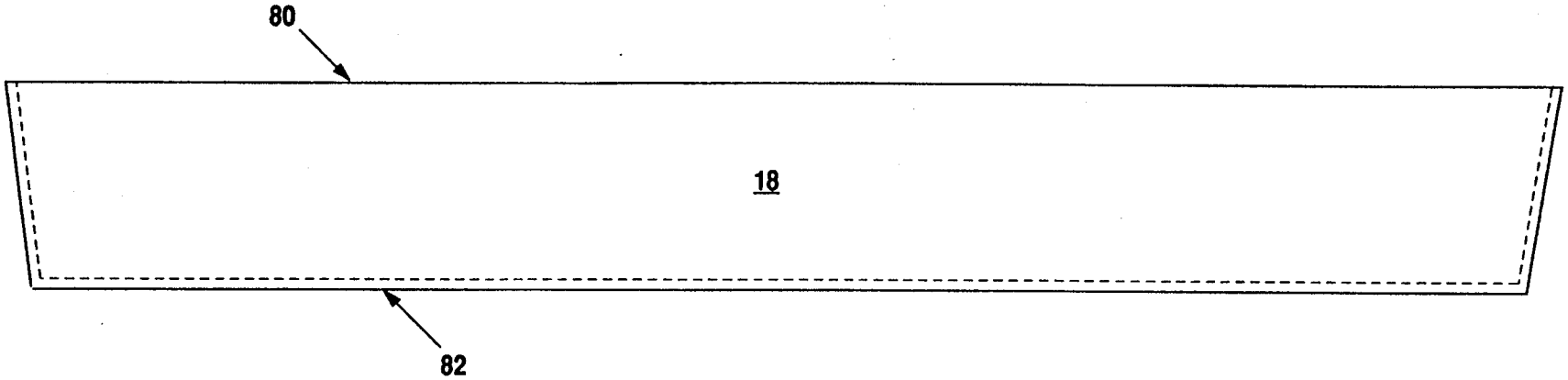
FIG. 8*a* is a detailed front view of the tray cross rail of the present invention.
Figure 8B:
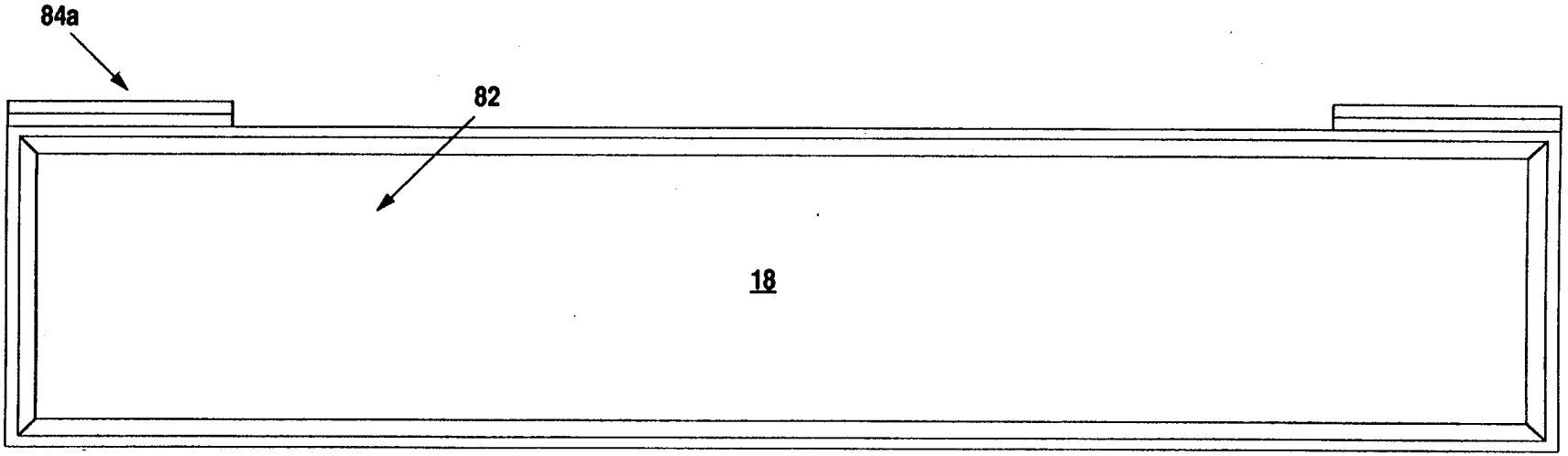
FIG. 8*b* is a detailed top view of the tray cross rail of the present invention.

Reference is now made to FIG. 8*a* through 8*c* for a detailed description of tray cross rail (18) of the present invention Tray cross rail (18) shown in FIG. 8*a* from the front is essentially a rectangular boxed shaped tray of relatively shallow depth for the purpose of retaining rings, clasps, broaches, and other small items of jewelry and accessories (not shown). The shape of cross rail tray (18), as shown in FIG. 8*a*, is slightly tapered from top (80) to bottom (82) so as to facilitate access and cleaning of tray 18).

In FIG. 8*b*, attachment means (84*a* and 84*b*) for tray cross rail (18) are shown on each end of tray (18) itself. The attachment means (84*a* and 84*b*) described is quite similar to the attachment means for loop hanger cross rail (20) and side hooks (22). Again, opposing upper (84*a*) and lower (84*b*) channels are designed to be rotatably insertable into channel (50) between two T-shaped protrusions (52) on side rails (14). FIG. 8*c* shows in more detail this means for attachment which, as indicated, is essentially the same as that for other cross rails.

Figure 9A:
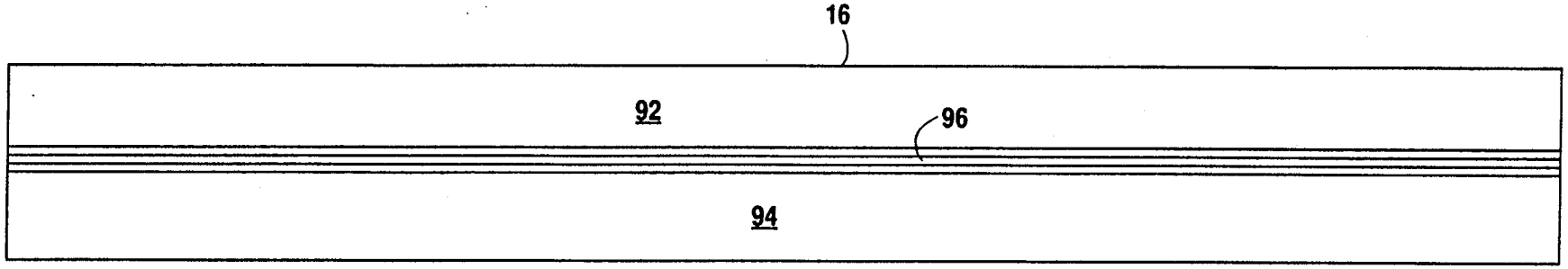
FIG. 9*a* is a detailed front view of the earring cross rail of the present invention.
Figure 9B:
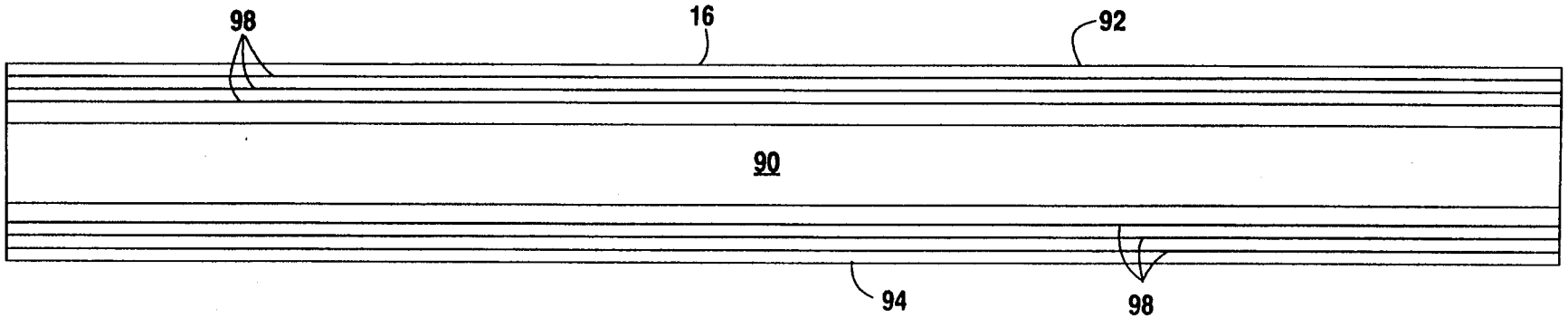
FIG. 9*b* is a detailed rear view of the earring cross rail of the present invention.

Reference is now made to FIG. 9*a* through 9*b* and again to FIG. 7*c* for a description of earring cross rails (16) and their means for attachment to side rails (14). FIG. 9*a* is a front view of earring (16) cross rail showing upper attachment surface (92) and lower attachment surface (94) and pierced earring attachment slot (96) centrally located on the front face of rail (16). FIG. 9*b* is a rear view of rail (16) which discloses not only attachment surfaces (92 and 94), and central triangular protrusion (90) on the back of rail (16), but also discloses a series of parallel ridges (98) on the back side of both upper (92) and lower (94) faces of earring cross rail (16). The functional characteristics of each of these portions of earring cross rail (16) are described in more detail with respect to FIGS. 10*a–c*, wherein a cross sectional view of rail (16) makes its function more apparent.

FIG. 7*c* also discloses the means for attachment of earring cross rail (16) to side rails (14), which differs slightly from the attachment means for the other types of cross rails. Triangular protrusion (90) described with respect in FIG. 9*b* is entirely insertable into channel (50) between T-shaped protrusions (52) on side rails (14). Hereagain, attachment is made, however, by means of inserting a lower edge of triangular protrusion (90) of earring cross rail (16) into a lower portion of space (50) between T-shaped protrusions (52) near the base of a lower one of the two T-shaped protrusions (52). Rotation of earring cross rail (16) up into space (50) between T-shaped protrusion (52) snaps cross rail (16) into place and results in the exertion of force inward on the side walls of triangular protrusion (90) by the edges of T-shaped protrusions (52) from side rails (14). This is an essential force as will be described in more detail below.

Earring cross rails (16) thereby extend outward from side rails (14) and present the various portions of cross rail (16) for easy access and use for the attachment and insertion of different types of earrings.

Reference is now made to FIGS. 10*a* through 10*c* for a detailed description of the functional aspects of the various features of earring cross rails (16) of organizer (10).

FIG. 10*a* discloses typical pierced earring (100) with stud (99) and rear attachment means (101), as well as the top aesthetic portion of the pierced earrings, typically a pearl, bead, precious stone, or other metallic mount normally of small size. The configuration of earring cross rail (16) is such that longitudinal slot (96) is formed between upper rail face (92) and lower rail face (94), which longitudinal slot (96) is normally held closed by the resilient pressure of the configuration of rail (16) itself and is supplemented in this closed configuration by pressure exerted by T-shaped protrusions (52) on side rail (14) as described above. Primarily, however, slot (96) is retained in a closed position with a certain amount of resilient pressure by the cross sectional structure of earring cross rail (16). The structure, as disclosed, allows for the insertion of stud portion (99) of a pierced earring (100) into earring cross rail (16) without the necessity of removing attachment portion (101) of pierced earring (100). The depth of interior space (110) within earring cross rail (16) is sufficient to accommodate pierced earrings (100) with varying lengths of stud (99). Valley (112) formed immediately outside longitudinal slot (96) in earring cross rail (16) is of a size sufficient to accommodate a variety of pierced earring attachment means (101). The area immediately outside attachment means area (112) described, tapers outwardly to snugly accommodate whatever type of earring top in the way of a bead, pearl, or stone might be attached to base (99) of earring (100). This sequence of open valleys (112) spaced out from longitudinal slot (96) allow for not only the snug attachment of stud earring (100), but also the easy placement and removal of earring (100) from earring cross rail (96).

In FIG. 10*b*, the means for attachment of a typical loop earring (106) or other fine wire earring that relies upon a pierced ear, but is not configured as with a typical stud attachment pierced earring, is shown. Loop earring (106) is simply hooked over attachment face (92) and is held in place by gravity.

Reference is now made to FIG. 10*c* for a detailed description of the function of upper (92) and lower (94) faces of earring cross rail (16) and their use for retaining and displaying clasp or clip on type earrings. A typical button or broach type clip on earring (102) that does not have dangling elements might be attached to upper face (92) of earring cross rail (16) by clipping the typical jaw shaped attachment means onto upper face (92) of cross rail (16). Parallel ridges (98) on the back side of upper face (92) of cross rail (16) facilitate the retention of earring (102) on rail (16) and prevent its accidental removal.

A similar means for attachment is found on lower face (94) of earring cross rail (16) in a manner that mirrors the attachment means on upper face (92). Lower face (94) is typically used for dangling type clip on earrings (104) whose various dangling elements would interfere with the use of central pierced earring channel (96) on earring cross rail (16). Similar parallel ridges (98) on the back side of lower face (94) further facilitate the retention of clip on earring (104) and prevents its accidental removal from earring cross rail (16). As an additional safeguard against earring (104) slipping from face (94), a thin layer of friction increasing material may be placed across parallel ridges (98).

As indicated above, it is anticipated that the organizer of the present invention might be presented to the consumer in a basic package that includes a number of earring cross rails, a single tray cross rail, a single loop hanger cross rail, a plurality of side hooks, and the necessary one or two pair of side rails (14). Individual elements of the organizer, however, from individual side rails (14) to additional tray cross rails and so on would be presented to the consumer for their customizing of the organizer. It is anticipated that the consumer could construct whatever combination of side rails (14) and cross rails (16, 18, and 20) that would be appropriate for their particular articles of jewelry and fashion accessories. It is also anticipated that additional cross rails that incorporate modifications to those described in the preferred embodiment might easily be created for specific fashion articles that are not precisely suited to the specific cross rails described herein. Although the organizer of the present invention has been described with respect to a preferred embodiment and a number of preferred cross rails (16, 18, and 20) for attachment to side rails (14) have been described in the invention, it is anticipated that those skilled in the art would recognize and could implement additional cross rail elements that would still fall within the scope of the described invention and the appended claims.

We claim:

1. An organizer assembly for the retention, display, and presentation for access, of jewelry and fashion accessories, comprising:

at least two parallel side rails, said side rails having a plurality of first retention means intermittently spaced along their lengths, said side rails further having attachment means for attachment of said side rails to a vertical planar surface;

a plurality of cross rails for extension between said side rails, said cross rails having second retention means matable to said first retention means on said side rails in a manner that prevents said cross rails from accidental removal from side rails, said cross rails further comprising means for retaining, displaying, and presenting for access, a variety of items of jewelry and fashion accessories; and a plurality of side hooks, said side hooks having third retention means matable to said first retention means on said side rails, each of said side hooks removably attachable to one of said side rails without extending between said side rails;

wherein said side rails, when attached to said vertical planar surface, provide a frame work for retention of said plurality of cross rails and said plurality of side hooks, said side rails, said cross rails, and said side hooks providing a plurality of retention points for display, and presentation for access of a plurality of jewelry and fashion accessory items.

2. The organizer of claim 1, wherein said plurality of cross rails includes a plurality of earring cross rails, said earring cross rails having means for retaining, displaying, and providing access to, both pierced earrings and clip on earrings.

3. The organizer of claim 2, wherein said earring cross rails each comprise:

a first upper attachment bar, said first attachment bar extending along and providing a first upper edge onto which said clip on earrings may be attached;

a second lower attachment bar, said second attachment bar extending along an entire length of said earring cross rail and providing a second lower edge onto which said clip on earrings may be attached;

a central retainer bar, said retainer bar extending along an entire length of said first attachment bar and along an entire length of said second attachment bar, said retainer bar serving to join said first attachment bar to said second attachment bar, said retainer bar further defining a channel extending along an entire length of said earring cross rail between said first and second attachment bars, said channel providing a slot into which said pierced earrings may be inserted and retained.

4. The organizer of claim 3 wherein said retainer bar places said first attachment bar in parallel, longitudinal contact with said second attachment bar, said contact being of a force sufficient to retain said pierced earrings.

5. The organizer of claim 1, wherein said plurality of cross rails includes at least one tray cross rail capable of retaining a plurality of rings, broaches, and other loose items of jewelry and fashion accessories.

6. The organizer of claim 5 wherein said tray cross rail comprises an open rectangular container, said container having a base and four sides.

7. The organizer of claim 1, wherein said plurality of cross rails includes at least one loop hanger cross rial, said loop hanger cross rail capable of retaining, displaying, and presenting for access a plurality of bracelets, necklaces, belts, and other loop structured items of jewelry and fashion accessories.

8. The organizer of claim 7 wherein said loop hanger cross rail comprises:

a rail base;

a plurality of hanger posts extending from said rail base; and a plurality of post caps, each of said post caps terminating one of said hanger posts;

wherein said hanger posts are sized to receive said bracelets, necklaces, belts, and other loop structured items, and said post caps serving to prevent said items from accidental removal from said hanger posts.

* * * * *